US005709270A

United States Patent [19]

Theurer et al.

[11] Patent Number: 5,709,270

[45] Date of Patent: Jan. 20, 1998

[54] BALLAST SUCTION MACHINE

[75] Inventors: Josef Theurer, Vienna; Herbert Wörgötter, Gallneukirchen; Friedrich Oellerer, Linz, all of Austria

[73] Assignee: Franz Plasser Bahnbaumaschinen-Industriegesellschaft m.b.H., Vienna, Austria

[21] Appl. No.: 803,323

[22] Filed: Feb. 21, 1997

Related U.S. Application Data

[63] Continuation of Ser. No. 417,657, Apr. 5, 1995, abandoned.

[30] Foreign Application Priority Data

Apr. 18, 1994 [AT] Austria ..... 806/04
Jul. 1, 1994 [AT] Austria ..... 1307/94

[51] Int. Cl.[6] ..... E01B 27/00

[52] U.S. Cl. ..... 171/16; 37/104; 104/2

[58] Field of Search ..... 171/16; 37/104, 37/105, 106, 317, 320, 324, 326, 328, 336; 15/363, 414, 23, 54, 93.3, 340.1, 347; 104/2, 7.1, 279

[56] References Cited

U.S. PATENT DOCUMENTS

| | | | |
|---|---|---|---|
| 133,022 | 11/1872 | Du Faur et al. | 37/317 |
| 243,462 | 6/1881 | Sanders | 37/320 |
| 355,094 | 12/1886 | Lewis | 37/320 |
| 413,091 | 10/1889 | Riker | 37/320 |
| 1,483,674 | 2/1924 | Owen | 171/16 |
| 1,576,093 | 3/1926 | Cooke | 171/16 |
| 1,861,349 | 5/1932 | Lockett | 37/320 X |
| 3,624,933 | 12/1971 | Faldi | 37/320 |
| 3,803,856 | 4/1974 | Faldi | 37/320 X |
| 4,278,365 | 7/1981 | Sandberg | 37/317 X |
| 4,741,072 | 5/1988 | Wilkerson . | |
| 5,425,188 | 6/1995 | Rinker | 37/317 |
| 5,452,528 | 9/1995 | Theurer et al. | 171/16 X |
| 5,456,181 | 10/1995 | Theurer et al. | 171/16 X |
| 5,502,904 | 4/1996 | Theurer et al. | 171/16 X |
| 5,553,674 | 9/1996 | Theurer et al. | 171/16 |
| 5,555,941 | 9/1996 | Theurer et al. | 171/16 |
| 5,611,403 | 3/1997 | Theurer et al. | 171/16 |

FOREIGN PATENT DOCUMENTS

| | | | |
|---|---|---|---|
| 7127884 | 12/1971 | Germany . | |
| 2136306 | 1/1973 | Germany . | |
| 89 13 731 | 2/1990 | Germany . | |
| 4108673 | 9/1992 | Germany . | |
| 2172326 | 9/1986 | United Kingdom . | |
| 2270943 | 3/1994 | United Kingdom | 171/16 |
| 2273515 | 6/1994 | United Kingdom | 171/16 |

*Primary Examiner*—Terry Lee Melius
*Assistant Examiner*—Victor Batson
*Attorney, Agent, or Firm*—Collard & Roe, P.C.

[57] ABSTRACT

A machine for aspirating ballast from a bed supporting a track comprises a machine frame and undercarriages supporting the machine frame on the track for mobility therealong. A vacuum generator and a ballast storage receptacle are mounted on the machine frame. A suction tube is connected to the vacuum generator, the suction tube terminating in a tubular end section having a longitudinal axis and defining a suction opening at one end thereof for aspirating the ballast, the tubular end section being rotatable about the longitudinal axis. A displacement mechanism attaches the suction tube to the machine frame for vertically and transversely displacing the tubular suction tube end section, the displacement mechanism comprising drives for vertically and transversely displacing the tubular suction tube end section, and a drive is provided for rotating the tubular suction tube end section in a direction of rotation.

15 Claims, 2 Drawing Sheets

BALLAST SUCTION MACHINE

CROSS-REFERENCE TO RELATED APPLICATION

This is a continuation of our U.S. patent application Ser. No. 08/417,657, filed Apr. 5, 1995, now abandoned.

BACKGROUND OF THE INVENTION

1. Field of the Invention

The present invention relates to a machine for aspirating ballast from a bed supporting a track, which comprises a machine frame and undercarriages supporting the machine frame on the track for mobility therealong. A vacuum generator and a ballast storage receptacle are mounted on the machine frame, and a suction tube is connected to the vacuum generator, the suction tube terminating in a tubular end section having a longitudinal axis and defining a suction opening at one end thereof for aspirating the ballast. A displacement mechanism attaches the suction tube to the machine frame for vertically and transversely displacing the tubular suction tube end section, the displacement mechanism comprising drive means for vertically and transversely displacing the tubular suction tube end section.

2. Description of the Prior Art

In the ballast aspirating machine of British patent No. 2,172,326, which is of this general type, three vertically extending end sections of suction tubes are equipped with rotating tools at the suction openings to loosen encrusted ballast. To enable the machine to advance continuously along the track, the suction tube end sections are displaceable longitudinally relative to the machine frame. After the suction tube end sections have been centered in a crib, the suction tubes are lowered and the rotation of the tools enables adjoining ballast below the ties to be aspirated.

The ballast suction machine disclosed in German utility model No. 7,127,884, published Dec. 16, 1971, provides a vibrating mechanism at the suction opening defined by the suction tube end section for vibrating the suction opening, which has teeth. Alternatively, the ballast may be loosened by roller-shaped tools at the suction opening.

Various other ballast aspirating machines of this general type have been disclosed in German patent No. 2,136,306, U.S. Pat. No. 4,741,072, German patent No. 4,108,673 and German utility model No. 8,913,731, published Feb. 15, 1990.

SUMMARY OF THE INVENTION

It is a primary object of this invention to improve such a ballast aspirating machine so that the suction effect on the aspirated ballast is enhanced, particularly for encrusted ballast.

The above and other objects are accomplished in a machine of the first-indicated type with a tubular end section of the suction tube which is rotatable about the longitudinal axis and a drive for rotating the tubular suction tube end section in a direction of rotation.

The rotation of the tubular suction tube end section considerably enhances the aspiration of the ballast with a minimum of construction costs. The rotation of the suction opening in the tubular end section causes the adjacent ballast pieces to be moved, and this mechanically initiated movement is accelerated by the applied suction. Thus, the rotation of the suction opening enables the ballast to be rapidly and effectively aspirated. The effectiveness of the suction may be further enhanced with ballast entrainment elements projecting from the suction opening, as will be further explained hereinafter.

BRIEF DESCRIPTION OF THE DRAWING

The above and other objects, advantages and features of the invention will become more apparent from the following detailed description of certain now preferred embodiments thereof, taken in conjunction with the accompanying, somewhat schematic drawing wherein.

DETAILED DESCRIPTION OF THE PREFERRED EMBODIMENTS

Figure 1:
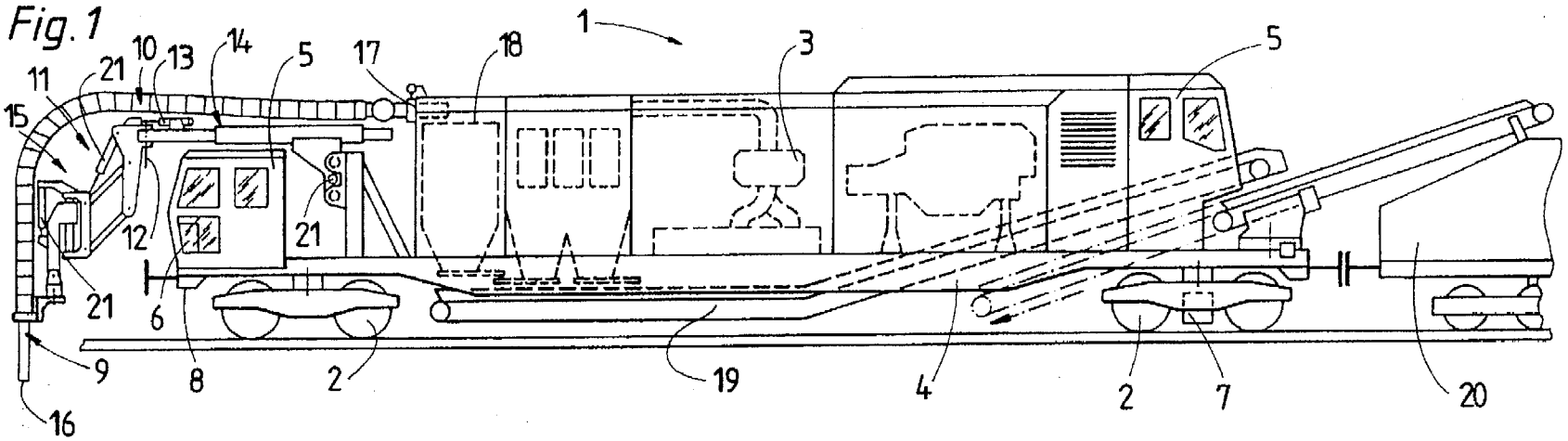
FIG. 1 shows a side elevational view of a ballast aspirating machine according to the present invention.

Referring now to the drawing and first to FIG. 1, there is shown machine 1 for aspirating ballast from a bed supporting a track. The machine comprises machine frame 4 and undercarriages 2 supporting the machine frame on the track for mobility therealong. Operator's cab 5 housing central control panel 6 is mounted at one end 8 of the machine frame and another cab 5 is mounted on the opposite machine frame end. The machine frame also carries a central power source for providing power to the operating drives of machine 1, including drive 7 for moving the machine along the track. Furthermore, vacuum generator 3 and ballast storage receptacle 18 are mounted on machine frame 4 on the machine frame, and suction tube 10 is connected to vacuum generator 3. The suction tube terminates in tubular end section 9 having longitudinal axis 23 and defining suction opening 16 at one end thereof for aspirating the ballast. To guide and support tubular suction tube end section 9, which projects from machine frame end 8, displacement and carrier mechanism 11 is cantilevered to machine frame end 8 and attaches suction tube 10 to machine frame 4 for vertically and transversely displacing tubular suction tube end section 9. The displacement mechanism comprises two carrier parts 14, 15 succeeding each other in the longitudinal direction of the machine frame and linked to each other at vertical swivel axis 12, and drive 13 connects part 14 to part 15 to enable carrier part 14 to be displaced transversely about the swivel axis. Drives 21 enable the mechanism to be vertically adjusted. Thus, drives 13 and 21 constitute drive means for vertically and transversely displacing tubular suction tube end section 9 in all three dimensions.

Figure 2:
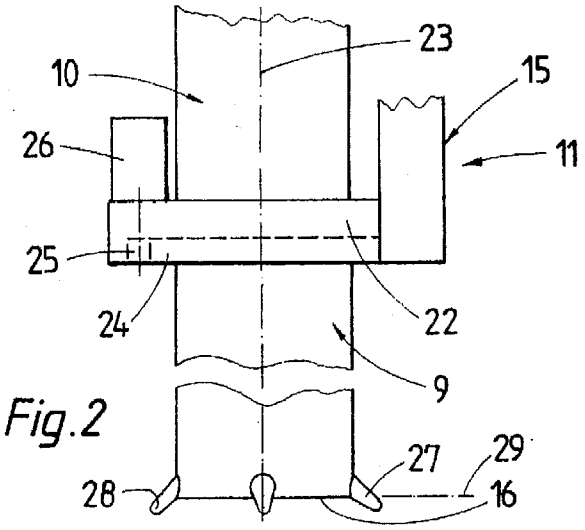
FIG. 2 is a fragmentary enlarged side elevational view illustrating the tubular suction tube end section defining a suction opening.

According to the invention and as is shown in FIG. 2, tubular suction tube end section 9 is rotatable about its longitudinal axis 23, and drive 26 is provided for rotating the tubular suction tube end section in a direction of rotation.

Tubular suction tube end section 9 is attached to carrier part 15 of displacement mechanism 11 and a section of suction tube 10 adjoining an end of the tubular end section opposite to the one end thereof is flexible. An end 17 of suction tube 10 which is opposite to suction opening 16 is mounted on the machine frame for displacement perpendicularly to the longitudinal direction of the machine frame as well as in a horizontal direction. Two ballast storage receptacles 18 are arranged on machine frame 3 transversely adjacent each other, and each receptacle has a discharge opening. Two filter chambers with closable discharge openings are mounted between the ballast storage receptacles and vacuum generator 3. Longitudinally extending conveyor band 19 is mounted below the discharge openings to enable the aspirated ballast to be conveyed to box car 20 coupled to machine 1. None of these specific structures form part of the present invention, and these structures are, therefore, shown only diagrammatically.

As illustrated in FIG. 2, tubular end section 9 further comprises bearing 22 at an end opposite to the one end defining suction opening 16 for rotatably connecting the tubular end section to the adjoining flexible suction tube section. Bearing 22 is attached to displacement mechanism carrier part 15 and hydraulic rotating drive 26 is connected to bearing 22. The illustrated bearing comprises gear ring 24 coaxially arranged about longitudinal axis 23 on tubular end section 9, and rotating drive 26 comprises drive gear 25 meshing with the gear ring.

As also shown in FIG. 2, entrainment elements 27 are affixed to cylindrical tubular end section 9 at suction opening 16 for loosening the ballast aspirated through the opening. The entrainment elements are finger-shaped and project radially outwardly from the tubular end section to loosen and move ballast pieces adjacent the suction opening for ready aspiration into the suction opening. As shown, suction opening 16 defines suction plane 29 extending perpendicularly to longitudinal axis 23 of tubular end section 9, and entrainment elements 27 have a longitudinal axis enclosing an angle with longitudinal axis 23 of the tubular end section and free ends 28 projecting downwardly beyond suction plane 29.

In operation, tubular suction tube end section 9 with its suction opening 16 is suitably positioned by actuating drives 13 and/or 21 from control panel 6 in cab 5 to be placed on the ballast in a crib, for instance. At the same time, drive 26 is actuated to rotate the tubular suction tube end section about longitudinal axis 23. This causes entrainment elements 27, which rotate with tubular end section 9, to impart an initial mechanical movement to adjacent ballast pieces and to entrain them into suction opening 16 whence they are sucked into suction tube 10 and conveyed into one of the ballast storage receptacles by the suction applied by suction generator 3. By transversely displacing tubular suction tube end section 9 across the track bed, the ballast may thus be removed from an entire crib. When one storage receptacle 18 is full, suction tube end 17 may be moved over to the adjacent receptacle.

Special operating conditions for aspirating ballast underneath the ties, for example, may make it necessary to use elongated entrainment elements 27. For this purpose, it is advantageous if the entrainment elements are detachably affixed to the tubular end section. This may be effected, for example, by attaching a portion of tubular suction tube end section 9 defining suction opening 16 and carrying entrainment elements 27 by a snap coupling to the remaining portion of the end section. In this way, a minimum time will be required for retrofitting the machine with optimal ballast entrainment elements for use under varying operating conditions.

Figure 3:
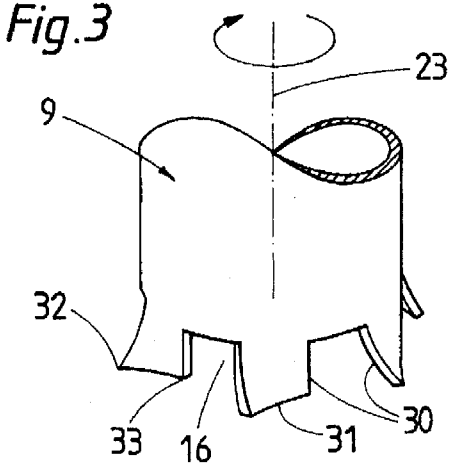
FIGS. 3 to 10 illustrate various embodiments of the tubular suction tube end section.

As shown in the embodiment illustrated in FIG. 3, the one end of tubular suction tube end section 9 defining suction opening 16 may be deformed to provide entrainment elements which are shovels 30 projecting downwardly beyond suction plane 16. The shovels have leading end portion 32 and trailing end portion 33 in the direction of rotation of the tubular end section (indicated by a circular arrow), and leading end portion 32 is farther removed from longitudinal axis 23 of tubular end section 9 than trailing end portion 33. Such rotating entrainment elements have a turbine-like effect and cause the ballast to be moved inwardly towards and into suction opening 16, thus increasing the efficiency of the ballast aspiration.

Figure 4:
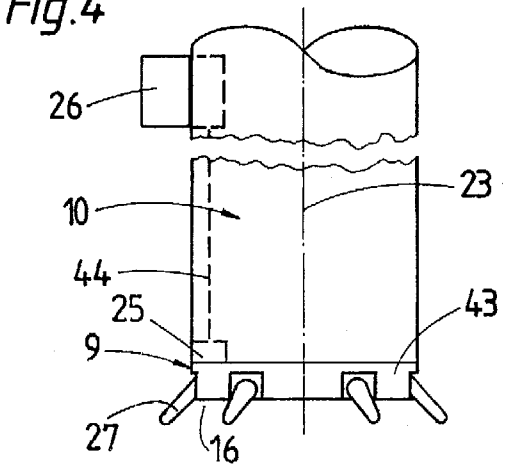

In the embodiment of FIG. 4, rotatable tubular end section 9 is a ring 43 rotatably mounted on suction tube 10 and entrainment elements 27 are detachably affixed to ring 43. Drive axle 44 of rotating drive 26, which is mounted on the suction tube, carries drive gear 25 mounted on ring 43 for rotating the ring.

Figure 5:
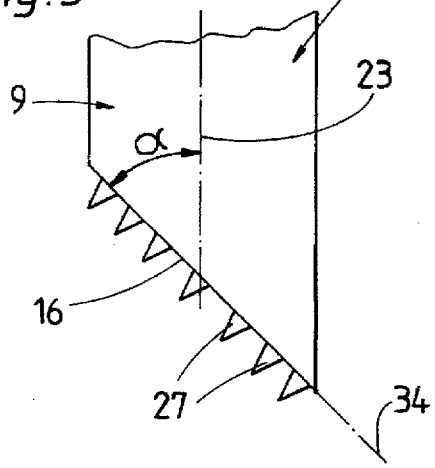

In the embodiment of FIG. 5, suction opening 16 defines obliquely extending suction plane 34 enclosing an angle $\alpha$ with longitudinal axis 23 of tubular end section 9. The angle $\alpha$ is about 30° to 50°, depending on the desired size of the suction opening, and is preferably 45°. The rim of the elliptical suction opening has tooth-shaped entrainment elements 27. The oblique positioning of suction opening 16 rotating about axis 23 enhances the suction effect on ballast adjacent the crib and under the ties.

Figure 6:
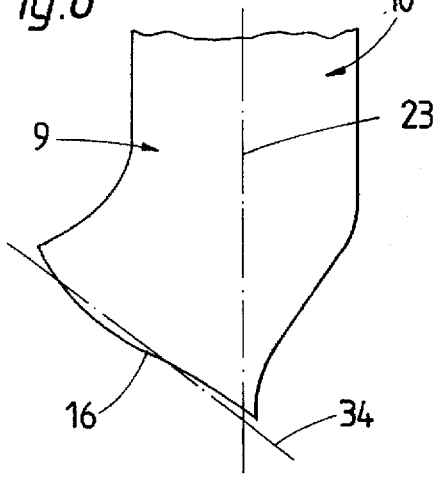

A variation of this embodiment with an obliquely positioned suction opening 16 is illustrated in FIG. 6. This is accomplished by bending a lower portion of tubular suction tube end section to enclose an angle with longitudinal axis 23.

Figure 7:
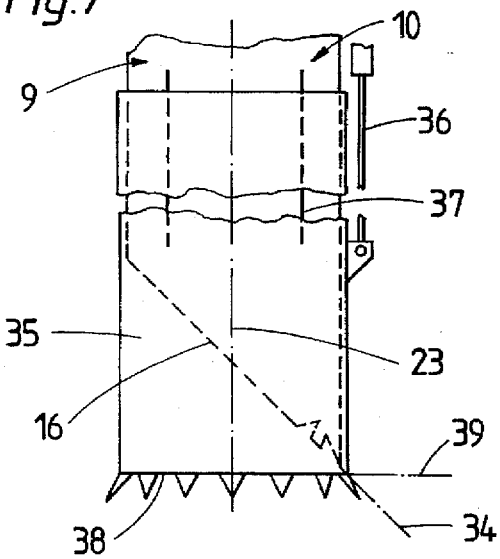
Figure 8:
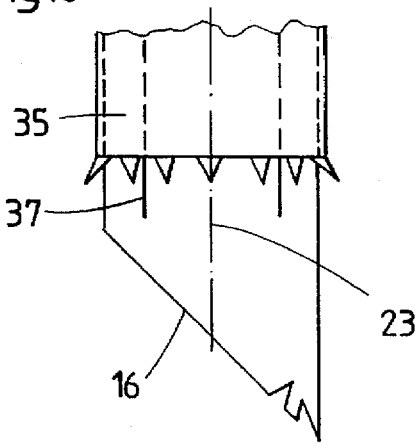

In the embodiment illustrated in FIGS. 7 and 8, a slidable tube 35 is vertically adjustably mounted on tubular end section 9 and extends coaxially about longitudinal axis 23 thereof. Slidable tube 35 has a lower end defining another suction opening 38 whose suction plane 39 extends perpendicularly to the longitudinal axis. Slidable tube 35 may be vertically adjusted relative to tubular suction tube end section 9 along guides 37 by diagrammatically shown drive 36. While suction plane 34 defined by suction opening 16 extends obliquely in the manner hereinabove described in connection with FIGS. 5 and 6, suction plane 39 of the other suction opening 38 extends perpendicularly to the longitudinal axis. In this way, vertical adjustment of slidable tube 35 enables the suction to be effected along a horizontal plane (FIG. 7) or an oblique plane (FIG. 8).

Figure 9:
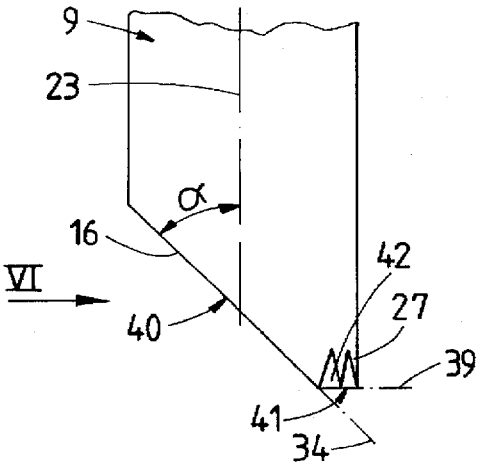
Figure 10:
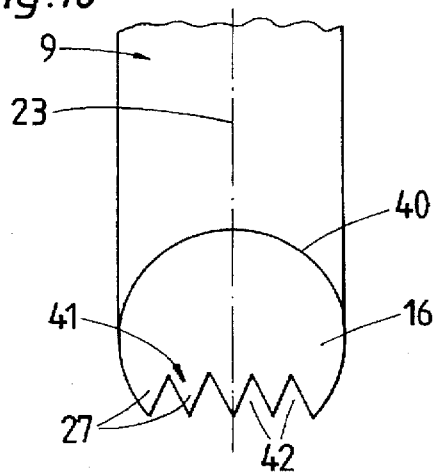

FIGS. 9 and 10 (FIG. 10 being a view of FIG. 9 in the direction of arrow 6) illustrate yet another embodiment of tubular suction tube end section 9, wherein upper portion 40 of suction opening 16 defines obliquely extending suction plane 34 while lower portion 41 of the suction opening defines plane 39 extending perpendicularly to longitudinal axis 23 of tubular end section 9. The tubular suction tube end section has a circular circumference and lower suction opening portion 41 extends over at least about a fourth of the circumference. The lower suction opening portion has an edge defining recesses 42 forming teeth-shaped entrainment elements 27.

What is claimed is:

1. A machine for aspirating ballast from a bed supporting a track, which comprises (a) a machine frame, (b) undercarriages supporting the machine frame on the track for mobility therealong, (c) a vacuum generator on the machine frame, (d) a ballast storage receptacle on the machine frame, (e) a suction tube connected to the vacuum generator, (1) the suction tube terminating in a substantially vertical tubular end section having a substantially vertically extending longitudinal axis and defining a suction opening at one end thereof for aspirating the ballast, the tubular end section being rotatable about the longitudinal axis, and (2) a section of the suction tube adjoining an end opposite to the one end of the tubular end section being flexible, (f) a bearing at the opposite end of the tubular end section for rotatably connecting the tubular end section to the adjoining flexible suction tube section for rotation of the tubular end section about the longitudinal axis, (g) a displacement mechanism attaching the suction tube to the machine frame for vertically and transversely displacing the tubular suction tube end section, the displacement mechanism comprising (1) drive means for vertically and transversely displacing the tubular suction tube end section, and (h) a drive on the bearing for rotating the tubular suction tube end section about the longitudinal axis while the ballast is being aspirated.

2. The ballast aspirating machine of claim 1, wherein the bearing comprises a gear ring coaxially arranged about the longitudinal axis on the tubular end section, and the rotating drive comprises a drive gear meshing with the gear ring.

3. The ballast aspirating machine of claim 1, further comprising entrainment elements affixed to the tubular end section at the suction opening for loosening the ballast aspirated through the opening.

4. The ballast aspirating machine of claim 3, wherein the entrainment elements are finger-shaped and project radially outwardly from the tubular end section.

5. The ballast aspirating machine of claim 3, wherein the suction opening defines a suction plane extending perpendicularly to the longitudinal axis of the tubular end section, and the entrainment elements have a longitudinal axis enclosing an angle with the longitudinal axis of the tubular end section and free ends projecting downwardly beyond the suction plane.

6. The ballast aspirating machine of claim 3, wherein the suction opening defines a suction plane, and the entrainment elements are shovels projecting downwardly beyond the suction plane, the shovels having leading and trailing end portions in the direction of rotation of the tubular end section, the leading end portion being farther removed from the longitudinal axis of the tubular end section than the trailing end portion.

7. The ballast aspirating machine of claim 3, wherein the entrainment elements are detachably affixed to the tubular end section.

8. The ballast aspirating machine of claim 3, wherein the rotatable tubular end section is a ring to which the entrainment elements are affixed.

9. The ballast aspirating machine of claim 1, wherein the suction opening defines an obliquely extending suction plane enclosing an angle $\alpha$ with the longitudinal axis of the tubular end section.

10. The ballast aspirating machine of claim 9, wherein the angle $\alpha$ is about 30° to 50°.

11. The ballast aspirating machine of claim 10, wherein the angle $\alpha$ is 45°.

12. A machine for aspirating ballast from a bed supporting a track, which comprises (a) a machine frame, (b) undercarriages supporting the machine frame on the track for mobility therealong, (c) a vacuum generator on the machine frame, (d) a ballast storage receptacle on the machine frame, (e) a suction tube connected to the vacuum generator, (1) the suction tube terminating in a substantially vertical tubular end section having a longitudinal axis and defining a suction opening at one end thereof for aspirating the ballast, an upper portion of the suction opening defining a suction plane extending obliquely with respect to the longitudinal axis while a lower portion of the suction opening defines a plane extending perpendicularly to the longitudinal axis, and (2) a section of the suction tube adjoining an end opposite to the one end of the tubular end section being flexible, (f) a bearing at the opposite end of the tubular end section for rotatably connecting the tubular end section to the adjoining flexible suction tube section for rotation of the tubular end section about the longitudinal axis, (g) a displacement mechanism attaching the suction tube to the machine frame for vertically and transversely displacing the tubular suction tube end section, the displacement mechanism comprising (1) drive means for vertically and transversely displacing the tubular suction tube end section, and (h) a drive on the bearing for rotating the tubular suction tube end section about the longitudinal axis.

13. The ballast aspirating machine of claim 12, wherein the tubular end section has a circular circumference and the lower suction opening portion extends over at least a fourth of the circumference.

14. The ballast aspirating machine of claim 12, wherein the lower suction opening portion has an edge defining recesses forming teeth-shaped entrainment elements.

15. A machine for aspirating ballast from a bed supporting a track, which comprises (a) a machine frame, (b) undercarriages supporting the machine frame on the track for mobility therealong, (c) a vacuum generator on the machine frame, (d) a ballast storage receptacle on the machine frame, (e) a suction tube connected to the vacuum generator, (1) the suction tube terminating in a substantially vertical tubular end section having a longitudinal axis and defining a suction opening at one end thereof for aspirating the ballast, an upper portion of the suction opening defining a suction plane extending obliquely with respect to the longitudinal axis, and (2) a section of the suction tube adjoining an end opposite to the one end of the tubular end section being flexible, (f) a slidable tube vertically adjustably mounted on the tubular end section and extending coaxially about the longitudinal axis thereof, the slidable tube having a lower end defining another suction opening whose suction plane extends perpendicularly to the longitudinal axis, (g) a bearing at the opposite end of the tubular end section for rotatably connecting the tubular end section to the adjoining flexible suction tube section for rotation of the tubular end section about the longitudinal axis, (h) a displacement mechanism attaching the suction tube to the machine frame for vertically and transversely displacing the tubular suction tube end section, the displacement mechanism comprising (1) drive means for vertically and transversely displacing the tubular suction tube end section, and (i) a drive on the bearing for rotating the tubular suction tube end section about the longitudinal axis.

* * * * *